US006470777B2

(12) United States Patent
Krupica et al.

(10) Patent No.: US 6,470,777 B2
(45) **Date of Patent: *Oct. 29, 2002**

(54) LOW PROFILE SIDE PUNCH FOR INTERNAL DRUM IMAGESETTER

(75) Inventors: Libor Krupica, Nashua, NH (US); Richard W. Peloquin, Houston, TX (US)

(73) Assignee: Agfa Corporation, Wilmington, MA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 11 days.

(21) Appl. No.: 09/240,982

(22) Filed: Jan. 29, 1999

(65) Prior Publication Data

US 2001/0023631 A1 Sep. 27, 2001

(51) Int. Cl.[7] ..... B26F 1/14

(52) U.S. Cl. ..... 83/13; 83/628; 83/686; 83/948; 83/633; 346/138

(58) Field of Search ..... 83/948, 337, 686, 83/628, 633, 13; 346/33 R, 138

(56) References Cited

U.S. PATENT DOCUMENTS 3,916,744 A * 11/1975 West
5,309,642 A * 5/1994 McGinnis
5,317,942 A * 6/1994 Nakajimi
5,598,739 A 2/1997 Blake et al. ..... 74/89
5,671,005 A * 9/1997 McNay et al. ..... 347/262
5,709,139 A * 1/1998 Shimizu et al. ..... 83/54
5,842,397 A * 12/1998 Shimizu et al. ..... 83/54
5,953,807 A * 9/1999 Garand ..... 29/464
5,996,206 A * 12/1999 Lynch et al.

* cited by examiner

*Primary Examiner*—Kenneth E. Peterson
(74) *Attorney, Agent, or Firm*—John A. Merecki; Robert A. Sabourin

(57) ABSTRACT

A low profile side punch assembly is provided to punch registration openings along the side edge of media in an imagesetter. The side punch assembly includes a punch actuator having a scissors configuration to provide a low profile. The punch assembly is fixed to a side face of the imagesetter. The punch assembly can be located at any location along the side face. This location can also be subsequently adjusted if necessary. The location of the punch pin is accurately set during manufacture with respect to the media surface of the imagesetter by a reference surface in the side face and by the side face of the drum. A drive mechanism for the punch actuator is also provided with a positive retraction of the actuator. The location of the punch pin may also be sensed to prevent advancement of the media before the punch pin has been retracted.

9 Claims, 6 Drawing Sheets

LOW PROFILE SIDE PUNCH FOR INTERNAL DRUM IMAGESETTER

BACKGROUND OF THE INVENTION

In electronic prepress systems, images to be printed by offset printing are scanned from photographic sources, digitized, assembled, and edited electronically at a workstation. The digitized images are then transmitted to a raster image processor (RIP) for half-tone screening and image rasterization. The RIP image, or rasterized image, to be printed is then transmitted from the RIP to an imagesetter for photographic or film recording onto a medium such as paper, film, or a printing plate.

An imagesetter includes a supply of unexposed photosensitive media, a recording support surface, and an image exposing system for forming the image to be recorded according to the RIP image data. The image exposing system may employ a laser beam, a cathode ray tube (CRT), an LED emitter, or the like as a radiation source. The media passes either from single sheets from a supply roll or as a web to the recording support surface at which point the photosensitive media is exposed by the radiation source, forming a latent image on the media. Numerous images may be recorded on the web consecutively. The exposed web is then advanced for transfer to a media processor where chemical processing occurs.

Three inks, yellow, magenta, and cyan, are used to print color images. Often black ink is also used. The inks are printed in small dots, sometimes overlaid, in varying amounts to create the desired colors when viewed. Thus, three or four black and white separation films must be imaged, one for each color.

In the printing process, the films are overlaid and must be aligned accurately to ensure a good quality image. Toward this end, registration openings or holes are punched in each film to serve as an alignment guide. The location of each pixel on each film is determined with respect to the registration holes which are punched along an edge of the media, generally either the leading edge or a side edge. Typically, the openings must be punched with an accuracy of 1 mil with respect to the image on the media.

SUMMARY OF THE INVENTION

In some applications, it is desirable to punch registration openings along the side of the media rather than along the leading edge. In internal drum imagesetters, however, there is a small clearance, approximately 0.5 inch, between the imaging surface of the drum on which the sheet of media is supported and the scanning apparatus. Due to this small clearance, prior art internal drum imagesetters have typically not provided side punch capability. The present invention provides an internal drum imagesetter with a low profile side punch to punch registration openings along the side edge of media in an internal drum imagesetter.

More particularly, the low profile side punch assembly includes a punch die mounted to the drum adjacent the side face of the drum. A punch opening is formed through the punch die. A punch actuator is movably, preferably pivotably, mounted with respect to the imagesetter. The actuator comprises a punch receiving arm having an end extending over the punch opening. A punch pin is mounted to the end of the punch receiving arm and aligned to be received in the punch opening. A drive mechanism is operatively coupled to the punch actuator to move the punch actuator with respect to the punch die to move the punch pin within the punch opening, to thereby punch a registration opening in a sheet of media which has been fed into the guide slot.

The side face of the drum includes a slot having a shoulder or other reference surface, such as a T-shaped or trapezoidal slot, formed therein. A correspondingly shaped fastening device is mounted within the slot to adjustably affix the punch die to the side face. During manufacture, the location of the punch opening is set to a determined distance from the side face of the drum, and an upper surface of the punch die is aligned with and parallel to the imaging surface of the drum by the reference surface.

The invention also relates to a method of punching a registration opening in an edge of a sheet of media on an imaging surface of an imagesetter. In the method, a side punch assembly is provided mounted to the side face of the imagesetter A sheet of media is advanced into the imagesetter with an edge of the sheet of media disposed in the side punch assembly. The drive mechanism is actuated to move the punch into the sheet of media.

The method further comprises actuating the drive mechanism to retract the punch pin from the sheet of media. In another step, a position of the punch pin is sensed and the drive mechanism is controlled to prevent retraction of the punch pin before the punch pin is retracted from the sheet of media.

BRIEF DESCRIPTION OF THE DRAWINGS

The invention will be more fully understood from the following detailed description taken in conjunction with the accompanying drawings in which.

DETAILED DESCRIPTION OF THE INVENTION

Figure 1:
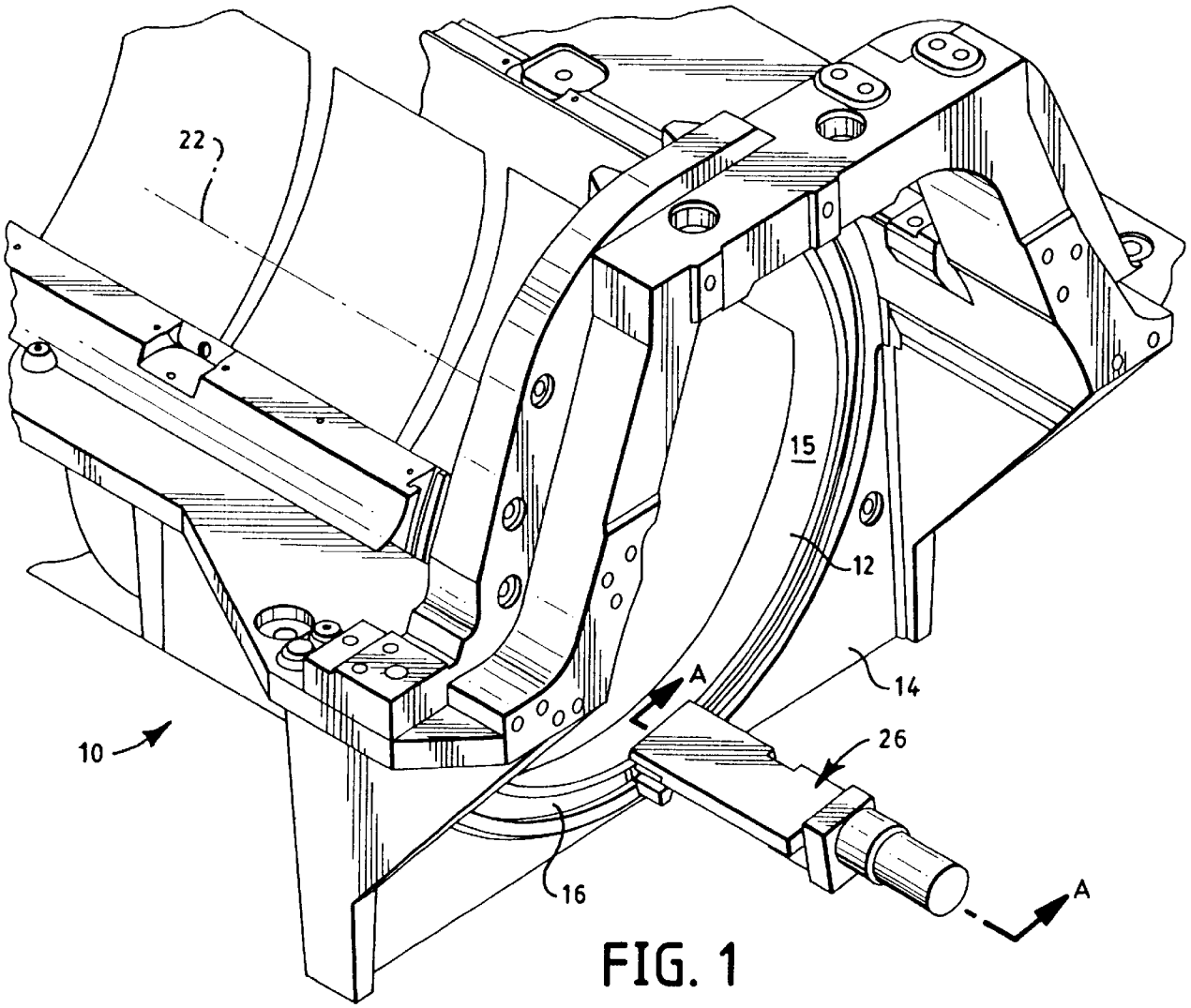
FIG. 1 is an isometric view of an internal drum imagesetter with side punch assembly according to the present invention.

Referring to FIG. 1, an imagesetter 10 or scanner includes an internal drum 12 having a partial cylindrical cross-section mounted to a support frame 14. The drum includes a concave media supporting imaging surface 15, on which a sheet of media 17 (see FIG. 2) to be imaged is located. The drum further includes a side face 16 disposed at an angle, typically 90°, to the imaging surface 15. A scanning apparatus (200) is mounted for movement parallel to a longitudinal axis 22 of the drum. See U.S. Pat. No. 5,598,739, the disclosure of which is incorporated by reference herein, for an example of an internal drum imagesetter or scanner.

One or more side punch assemblies 26 are mounted to the drum 12 adjacent the side face 16 to punch registration openings along the side edge of a sheet of media which has been fed into the drum. For simplicity, only one side punch assembly is illustrated in FIG. 1. The location and number of side punches is determined by the particular application and may accordingly vary from one imagesetter to another.

Figure 2:
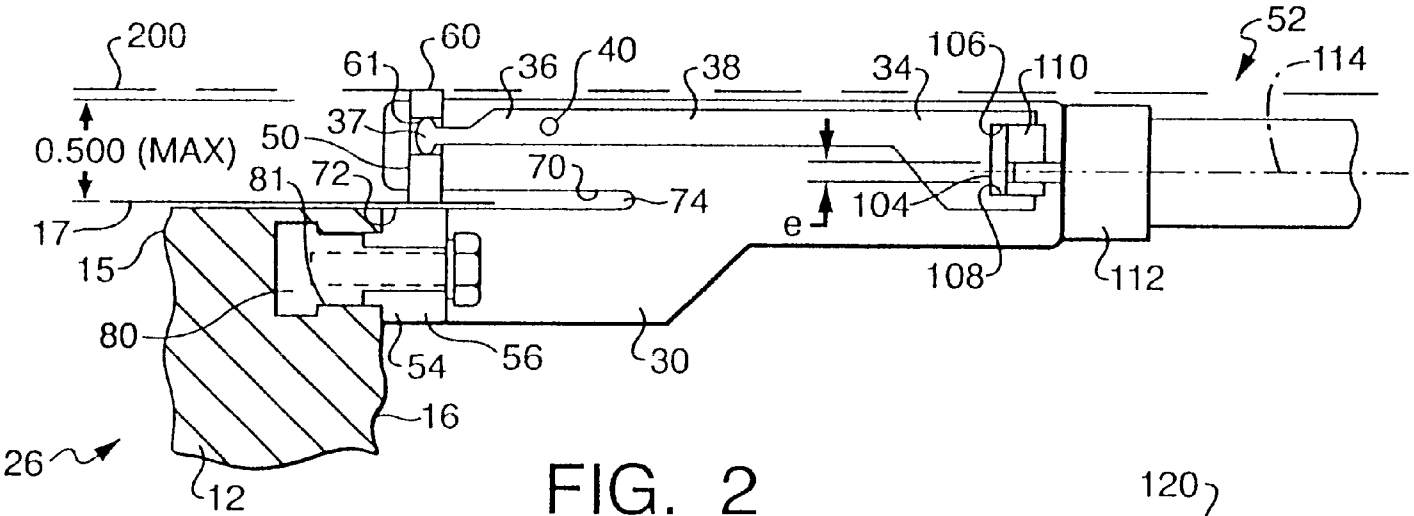
FIG. 2 is a partially cut-away, cross-sectional view of the punch assembly taken along line A—A of FIG. 1.

The operation of the punch assembly 26 is more readily described with reference to the embodiment illustrated in FIGS. 2 through 5. Each side punch assembly 26 comprises a body 30 which is mounted to the drum 12 adjacent to the side face 16. The body 30 may be attached to the imagesetter in any suitable manner, such as by screws or any other fastening device. Typically, there is approximately 0.5 inch clearance between the scanning apparatus and the media on the support surface, as indicated in FIG. 2. The maximum extent of body 30 above the imaging surface 15 is less than the clearance between the scanning apparatus and the media on the imaging surface 15.

A punch actuator 34 is provided having a scissors configuration in which two arm extensions 36, 38 extend from a pivot point 40. The punch actuator may be pivotably mounted to the punch body 30 at the pivot point 40 in any suitable manner. The arm extension 36 forms a punch receiving arm to receive a punch pin 60, described further below. The other arm extension 38, an actuating arm, is in contact with a drive mechanism 52, illustrated schematically in FIG. 2. By driving the actuator arm 38 upwardly, the actuator 34 pivots about the point 40 and drives the punch receiving arm 36 downwardly, to cause the punch pin 60 to enter the media. The drive mechanism, described further below, may include, for example, a motor, such as a stepper motor, solenoid, lead screw, air cylinder, or vacuum cylinder. A control processor (not shown) may be provided in communication with the actuating mechanism to control actuation of the punch assembly.

The punch pin 60 is mounted in a punch receiving opening 50 in the punch body 30. The punch pin 60 is mounted in any suitable manner to the punch receiving arm 36 to allow the punch pin to follow the punch receiving opening during actuation to punch the media at the desired location. In the preferred embodiment, the punch receiving arm 36 has a rounded head 37 which extends through an opening 61 in the punch pin. The rounded head 37 of the arm 36 allows vertical motion of the punch pin 60 and also, by contacting both upper and lower surfaces of the opening 61, provides forces to both drive the pin into the media and to positively retract the pin from the media. Positive retraction of the pin prevents or minimizes binding of the pin in the media, a problem with pins which are spring biassed to withdraw from the media, as in prior art devices.

A punch die 54 having a punch guide opening 56 therein is provided below the punch pin. The punch die may be, although is not necessarily, mounted to the punch body by, for example, screws or bolts. The punch receiving opening 50 and the punch guide opening 56 are accurately aligned and have a tight tolerance to be able to accurately guide the punch pin 60 into the media 17 at the desired location. The punch pin 60 may have any desired cross-sectional configuration and dimensions, depending on the application. Typically, the configuration of each punch pin differs from that of the other punch pins in a particular application.

The lower surface 70 of the punch body 30 and the upper surface 72 of the punch die 54 are spaced apart a slight distance to form a gap 74 sufficient to allow the edge of the sheet of media to fit therebetween. The lower surface 70 and the upper surface 72 are also curved to match the curvature of the imaging surface 15 of the drum 12 on which the media rests during imaging. The upper surface 72 of the punch die 54 aligns with the imaging surface 15 to form an extension thereof. In operation, the media is fed into the drum with the edge to be punched overlaying the edge of the imaging surface 15 a sufficient distance to allow the registration openings to be punched therein. The overlaying edge of the media is fed into the gap 74 between the upper surface 72 and the lower surface 70. The entrance edges 76 of these surfaces may be chamfered to ease entrance of the media into the gap (more clearly seen in the embodiment of FIGS. 6 and 7, described below). This configuration also allows the openings to be punched as close as possible to the side edge of the media, thereby minimizing waste of media which cannot be imaged.

The punch die 54 is affixed to the drum 12 with the punch pin 60 and guide opening 56 accurately aligned with respect to the imaging surface 15 and the side face 16 of the drum 12. A slot 80 is provided along the side face 16 of the drum 12. The slot 80 includes a shoulder or reference surface or radial control surface 81. The distance d (see FIG. 6) of the reference surface 81 from the imaging surface 15 is held constant to within a close tolerance, for example, 0.001 inch, along the length of the slot. In this way, the slot matches any variations which may be present in the surface 15 of the drum 12. One or more correspondingly shaped fasteners or nuts 92 are mounted within the slot 80. In the embodiment illustrated, the slot 80 and the fastener 92 are T-shaped, although other configurations, such as trapezoidal or cone-shaped, may be used as well. The fastener 92 may be positioned in any location along the slot 80 according to the desired application. The fastener may be held in place in any suitable manner such as with screws 94. Preferably, one fastener is provided for each punch assembly. The fastener is curved to match the curvature of the slot 80. By providing a continuous slot 80 in the side face 16 of the drum 12, the fastener and location of the punch assembly 26 can be adjusted during the lifetime of the imagesetter if desired or necessary.

A nose 88 is provided on the die 54 to fit within a neck or narrowed portion 82 of the slot 80. The nose is affixed to the fastener 92 in any suitable manner, such as by one or more bolts 96. The nose includes a lower shoulder 98 which rests on the reference surface or radial control surface 81 of the slot 80. The distance between the surface 72 of the die and the lower shoulder 98 is accurately set during manufacture to match the distance d between the imaging surface 15 and the reference surface 81 of the slot 80. Preferably, this distance is controlled to be within a tolerance of 0.001 inch of the required distance. In this way, the surface 72 of the die is aligned with and parallel to the imaging surface 15 such that the edge of the sheet of media will not be raised or lowered with respect to the imaging surface 15, which could cause the image to be out of focus.

The location of the punch pin 60 when punching a sheet of media is set during manufacture to be a predetermined distance from the end 102 of the die 54 which abuts the side face 16 of the drum. The side face 16 thus functions as a reference surface or axial control surface. This distance is determined by the requirements of the particular application. Preferably, the distance is set by controlling the locations of the punch openings 50, 56 in the arm extension 36 and die 54 during manufacture. This distance is similarly controlled to be within a tolerance of, preferably, 0.001 inch of the required distance. The nose 88 is sized to ensure that it does not abut the fastener 92 so that it does not prevent the end 102 of the die from abutting the side face 16. In this manner, the location of the opening to be punched may be accurately controlled.

The desired location along slot 80 at which the punch assembly is affixed is preferably determined by providing a reference mark 120 on the side face and an alignment mark on the punch assembly or the fastener 92. The alignment mark is matched to the reference mark to locate the punch assembly. For example, the reference mark 120 may be a small hole drilled in the side face. The alignment mark may be a pin 122 sized to fit within the hole. Other suitable reference marks and alignment marks may be provided, however. Preferably, only a single reference mark is placed on the side face, for example, in the center, to which one punch assembly is aligned. Other punch assemblies are then located by reference from the single reference mark. For example, a template may be provided to locate other punch assemblies from the reference mark.

Figure 3:
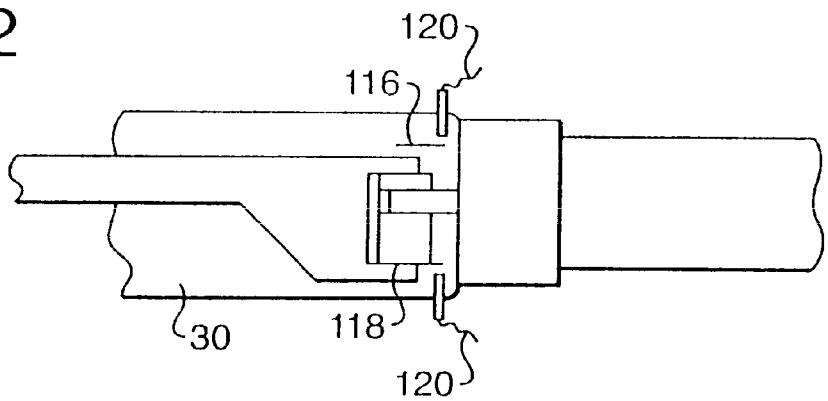
FIG. 3 is a partial view of the punch assembly of FIG. 2 illustrating a punch position sensor embodiment.
Figure 4:
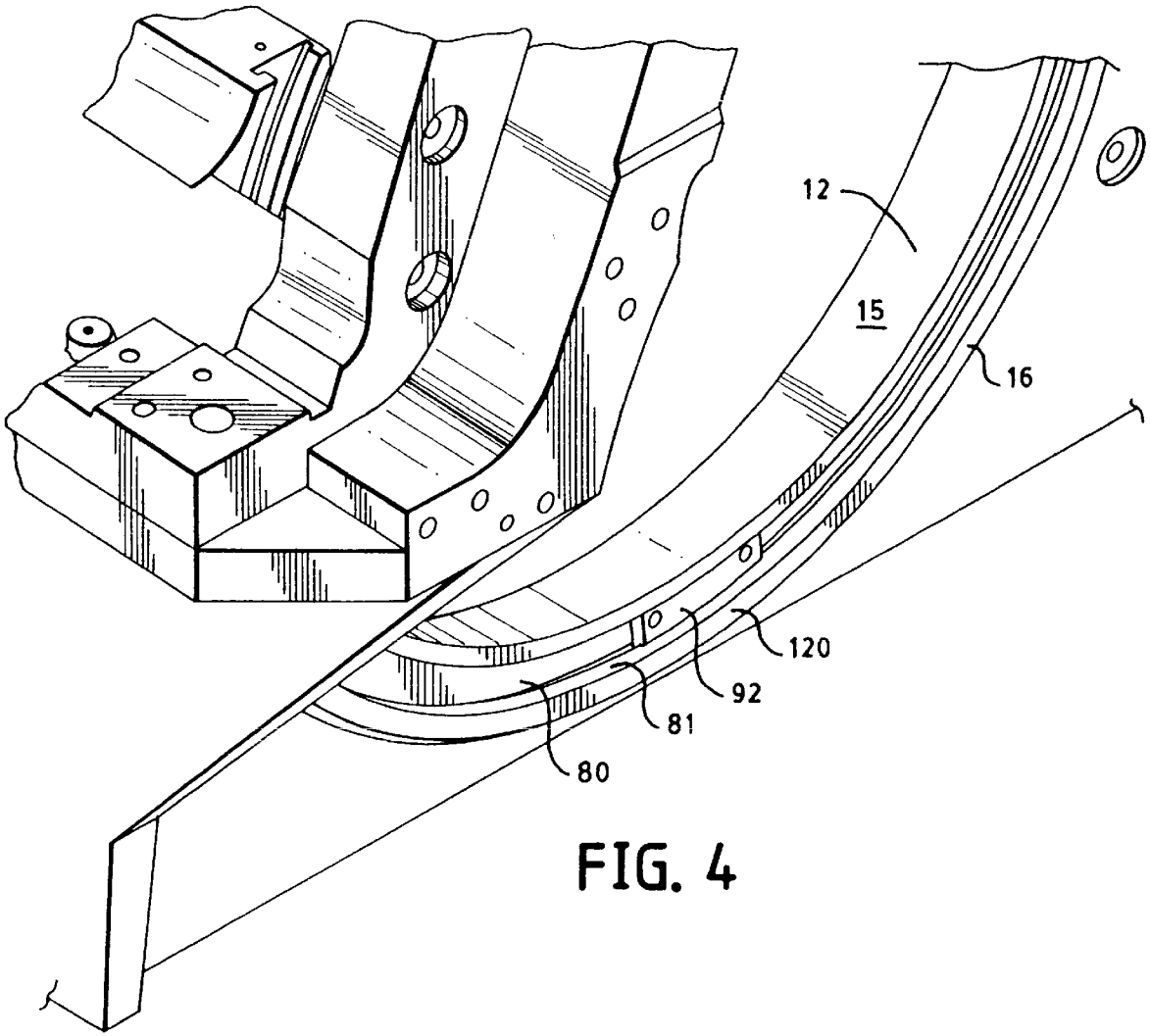
FIG. 4 is a partial isometric view of the imagesetter drum of FIG. 1.
Figure 5:
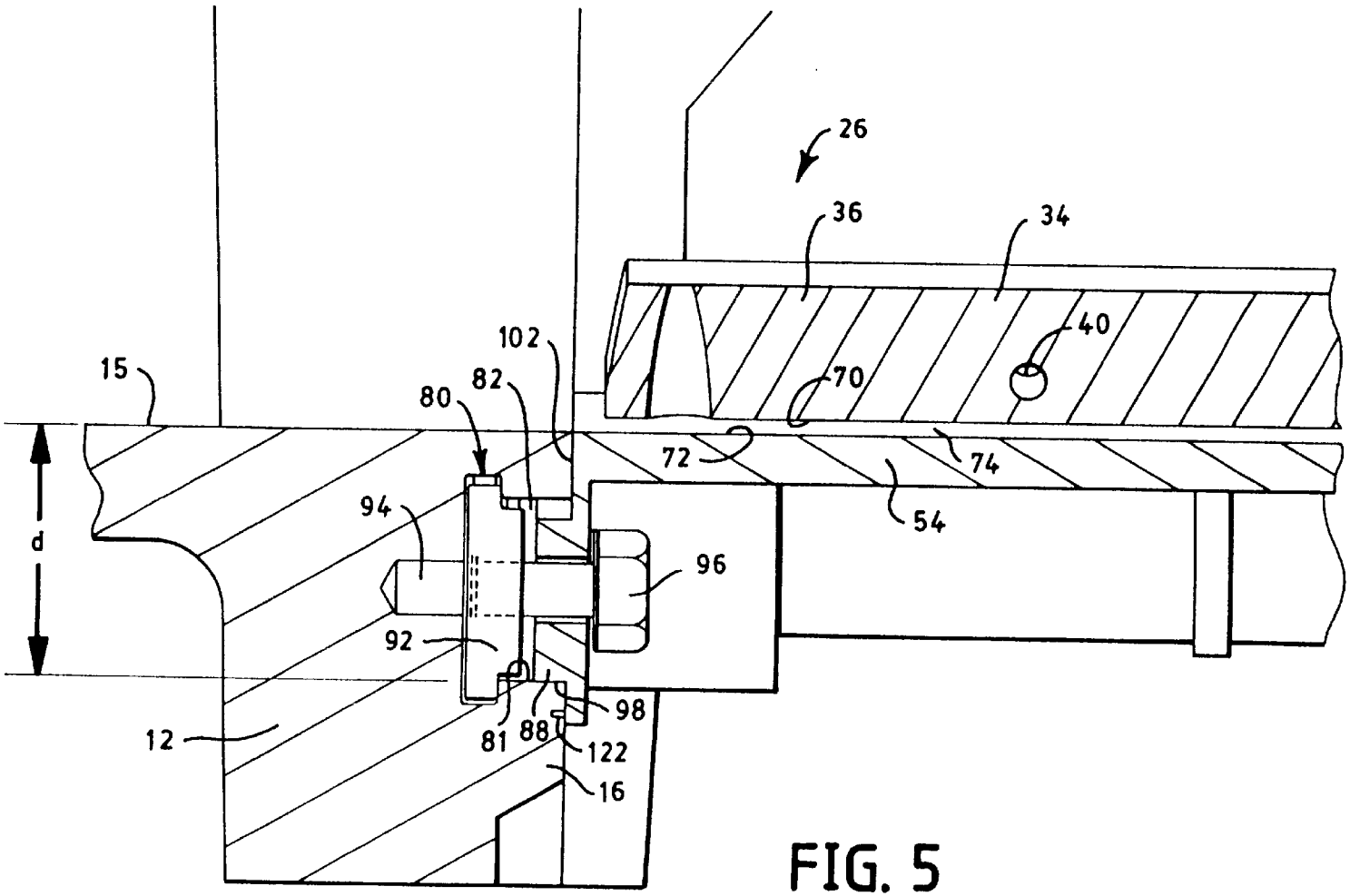
FIG. 5 is a partial cross-sectional view of the punch assembly taken along line A—A of FIG. 1.

FIGS. 2 and 3 illustrate a preferred drive mechanism 52 for actuation of the punch assembly 26. The actuator 34 is mounted at the pivot point 40 to the punch body or otherwise with respect to the imagesetter. The arm extension 38 includes an opening 104 having upper and lower cam follower faces 106, 108. A cam 110, driven by, for example, a motor 112, is mounted for rotation in the opening 104 between the cam follower faces 106, 108. The axis 114 of rotation of the cam is offset from the cam center and the midpoint of the opening 104 between the cam follower faces 106, 108 by an eccentricity e. Rotation of the cam 110 in a first direction causes the cam to raise the arm extension 38, thereby lowering the arm extension 36 and driving the punch pin 60 into the media. Continued rotation of the cam or rotation back in the opposite direction causes the cam to lower the arm extension 38, thereby raising the arm extension 36 and positively retracting the punch pin 60 from the media. Positive retraction of the punch pin is advantageous to prevent binding of the punch pin 60 within the media which may occur in prior art punch assemblies which utilize a spring mechanism to bias the punch pin away from the media.

The position of the punch pin is preferably controlled over time in any suitable manner. For example, a home or reference position or positions of the pin, such as the uppermost position 116 or lowermost position 118 of the arm 38, are determined. See FIG. 3. Other positions of the pin may then be sensed or tracked by reference to the home or reference position or positions. For example, one or more sensors 130 set to sense the position of the cam, an encoder on the motor shaft, or an optical switch set to sense the position of the punch pin may be provided. By knowing the position of the punch pin, the controller is able to ensure that the media is not advanced from the imagesetter before the punch pin has been retracted from the media, thereby preventing tearing of the media.

Figure 6:
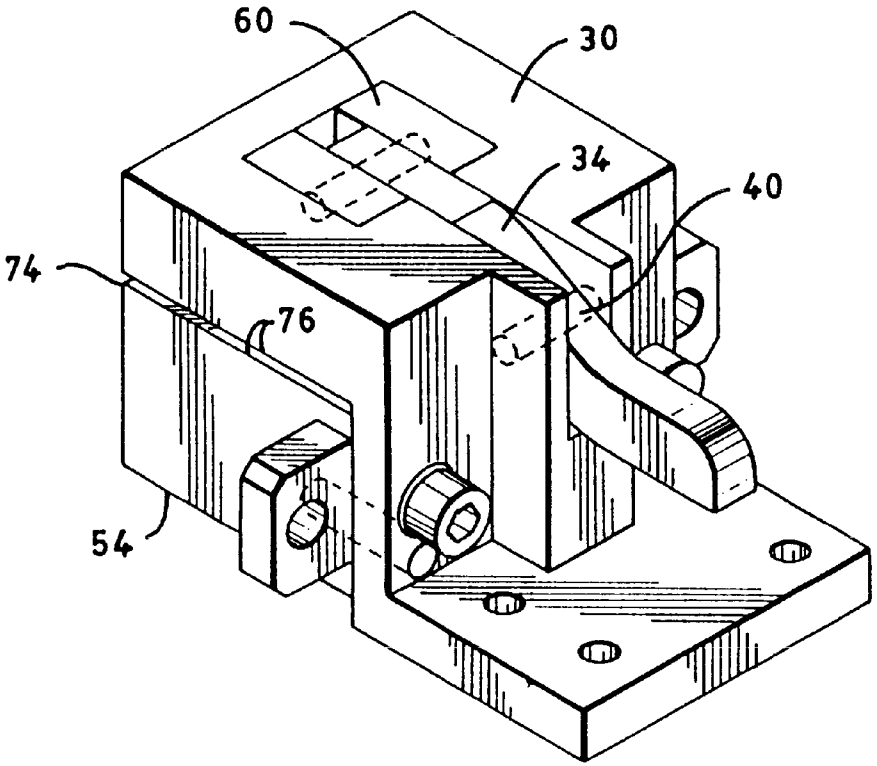
FIG. 6 is an isometric view of an alternative embodiment of a side punch assembly according to the present invention.
Figure 7:
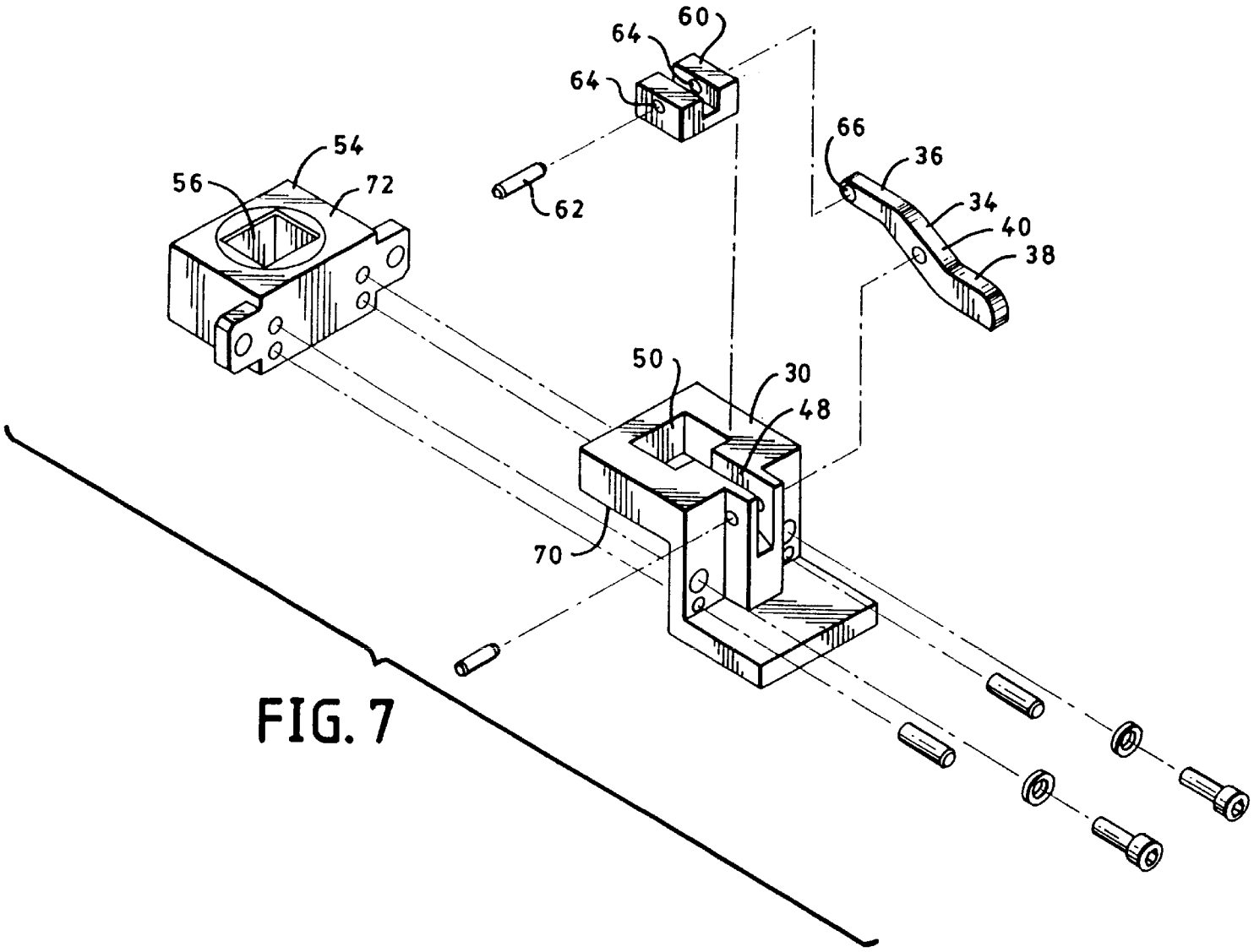
FIG. 7 is an exploded isometric view of the side punch assembly of FIG. 6.

An alternative embodiment of a punch assembly is illustrated in FIGS. 6 and 7. Operation of this punch assembly is substantially as described above, with like elements referenced by like numerals. In this embodiment, the punch pin 60 is attached to the arm extension 36 by a pin 62 through holes 64 in the punch pin 60 and a slot 66 near the end of the punch receiving arm 36.

The side punch assembly of the present invention may be used in conjunction with an imagesetter that also includes a head punch assembly which punches openings in the leading edge of a sheet of media. Similarly, another side punch assembly may be located on the opposite side of the imagesetter, such that openings may be punched along both edges of the media.

It will be appreciated that other variations of the above preferred embodiment are contemplated within the scope of the present invention. For example, the slot 80 could have a different configuration, such as an angled, trapezoidal, or cone-shaped configuration, rather than a T-shaped configuration to assist in retaining the fastening device therein. Although shown as two separate pieces, the punch body and punch die may be formed as an integral or unitary member. Similarly, although the invention has been illustrated in conjunction with an internal drum having a cylindrical concave support surface, the media-supporting imaging surface may be flat or have other curvatures. The punch assembly of the present invention may be used in conjunction with an external drum imagesetter having a convexly curved imaging surface. Other mechanisms for moving the punch pin may be provided, such as linearly depressing the punch receiving arm, as long as clearance with the scanning apparatus is maintained. The invention is not to be limited by what has been particularly shown and described, except as indicated by the appended claims.

What is claimed is:

1. An apparatus, comprising: an imagesetter, the imagesetter having an imaging surface disposed to receive a sheet of media and a side face disposed at an angle to the imaging surface, and a scanning apparatus movable above the imaging surface and defining a clearance gap between the scanning apparatus and the sheet of media on the imaging surface; and a low profile side punch assembly, the side punch assembly comprising:

a punch die mounted to the side face, the punch die having an upper surface to receive an edge of the sheet of media, and a punch opening formed through the punch die;

a punch actuator comprising a punch receiving arm having an end extending over the punch opening and mounted for movement over the punch opening, the punch actuator having a profile extending no greater than the clearance gap, wherein the clearance gap is no greater than about 0.5 inches, wherein said scanner is movable over said punch actuator with minimal clearance therebetween;

a punch pin mounted to the end of the punch receiving arm, the punch pin aligned to be received in the punch opening; and a drive mechanism mounted to the imagesetter and operatively coupled to the punch actuator to move the punch actuator with respect to the punch die to move the punch pin within the punch opening.

2. The apparatus of claim 1, wherein the side face includes a slot formed therein, and further comprising a correspondingly shaped fastening device mounted within the slot to affix the punch die to the side face.

3. The apparatus of claim 2, wherein the slot includes a reference surface located a determined distance from the imaging surface, the fastening device configured to align with the reference surface.

4. The apparatus of claim 2, wherein the slot is T-shaped and the fastening device is correspondingly T-shaped.

5. The apparatus of claim 2, wherein the punch die includes a nose element configured to fit within at least a narrower portion of the slot on the side face, the nose element fixed to the fastening device.

6. The apparatus of claim 2, wherein the slot includes a reference surface and the punch die includes a lower shoulder abutting the reference surface, a distance between the lower shoulder and the upper surface corresponding to a distance between the imaging surface and the reference surface sufficient to align the upper surface of the die to the imaging surface within a desired tolerance.

7. The apparatus of claim 1, wherein the upper surface of the punch die corresponds to the imaging surface, and wherein the imaging surface has a configuration selected from the group consisting of: concavely curved, convexly curved, and flat.

8. A method comprising:

providing an imagesetter, the imagesetter having an imaging surface disposed to receive a sheet of media and a side face disposed at an angle to the imaging surface, and a scanning apparatus movable above the imaging surface and defining a clearance gap between the scanning apparatus and the sheet of media on the imaging surface;

providing a side punch assembly mounted to the side face of the imagesetter, the side punch assembly comprising:

a punch die mounted to the side face, the punch die having an upper surface to receive an edge of the sheet of media, and a punch opening formed through the punch die;

a punch actuator comprising a punch receiving arm having an end extending over the punch opening and mounted for movement over the punch opening, the punch actuator having a profile extending no greater than the clearance gap, wherein the clearance gap is no greater than about 0.5 inches, wherein said scanner is movable over said punch actuator with minimal clearance therebetween a punch pin mounted to the end of the punch receiving arm, the punch pin aligned to be received in the punch opening; and a drive mechanism mounted to the imagesetter and operatively coupled to the punch actuator to move the punch actuator with respect to the punch die to move the punch pin within the punch opening;

advancing a sheet of media into the imagesetter with an edge of the sheet of media disposed in a punch assembly mounted to the side face of the imagesetter; and actuating the drive mechanism to move the punch in into the sheet of media.

9. The method of claim 8, further comprising the steps of:

actuating the drive mechanism to positively retract the punch pin from the sheet of media; and advancing the sheet of media from the imaging surface.

* * * * *